US007068802B2

(12) United States Patent
Schulz et al.

(10) Patent No.: US 7,068,802 B2
(45) Date of Patent: Jun. 27, 2006

(54) METHOD FOR THE OPERATION OF A DIGITAL, PROGRAMMABLE HEARING AID AS WELL AS A DIGITALLY PROGRAMMABLE HEARING AID

(75) Inventors: Hervé Schulz, Erlangen (DE); Tom Weidner, Nürnberg (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 114 days.

(21) Appl. No.: 10/188,124

(22) Filed: Jul. 2, 2002

(65) Prior Publication Data

US 2003/0002699 A1 Jan. 2, 2003

(30) Foreign Application Priority Data

Jul. 2, 2001 (DE) ..... 101 31 964

(51) Int. Cl.
*H04R 25/00* (2006.01)

(52) U.S. Cl. ..... 381/318; 381/320; 381/321

(58) Field of Classification Search ..... 381/312–313, 381/320–321, 316–318, 60
See application file for complete search history.

(56) References Cited

U.S. PATENT DOCUMENTS 5,303,306 A * 4/1994 Brillhart et al. ..... 381/315
5,321,758 A * 6/1994 Charpentier et al. ..... 381/317
5,365,233 A 11/1994 Schaub
5,706,351 A * 1/1998 Weinfurtner ..... 381/314
6,005,954 A * 12/1999 Weinfurtner ..... 381/312
6,044,163 A * 3/2000 Weinfurtner ..... 381/312
6,047,074 A * 4/2000 Zoels et al. ..... 381/313

FOREIGN PATENT DOCUMENTS

| | | |
|---|---|---|
| DE | 43 02 057 A1 | 8/1993 |
| DE | 196 19 312 | 11/1997 |
| DE | 196 24 092 | 11/1997 |
| EP | 0 250 679 | 7/1993 |

* cited by examiner

*Primary Examiner*—Curtis Kuntz
*Assistant Examiner*—Phylesha L Dabney
(74) *Attorney, Agent, or Firm*—Schiff Hardin LLP

(57) ABSTRACT

A method for operating a digital, programmable hearing aid is provided that uses both a transmission characteristic of a normal amplification as well as a transmission characteristic of a maximum amplification of an audio signal over a frequency range that can be nearly freely configured. Given a modification of the amplification by settings at the hearing aid as well as using parameters that result from the signal processing, the gain for the overall system is always calculated utilizing all parameters and is potentially limited to the maximum amplification at the respective frequency if this would otherwise be exceeded.

4 Claims, 6 Drawing Sheets

METHOD FOR THE OPERATION OF A DIGITAL, PROGRAMMABLE HEARING AID AS WELL AS A DIGITALLY PROGRAMMABLE HEARING AID

BACKGROUND OF THE INVENTION

1. Field of the Invention

The invention is directed to a method for the operation of a digital, programmable hearing aid having an input transducer for picking up an input signal and converting it into an audio signal, having a signal processing unit for the processing and frequency-dependent amplification of the audio signal, and having an output transducer. The invention is also directed to a digital, programmable hearing aid for implementing the method.

2. Description of the Related Art

Acoustic feedback frequently occurs in hearing aid devices, particularly for hearing aid devices having a high gain. This feedback is expressed in strong, feedback-caused oscillations at a specific frequency (feedback). This "whistling" is usually extremely unpleasant both for the hearing aid user as well as for persons in the immediate proximity.

Feedback can occur when sound that is picked up via the microphone of the hearing aid device, amplified by a signal amplifier and output via the earphone proceeds back to the microphone and is re-amplified. Two further conditions, however, must be met for the typical "whistling"—usually at a dominant frequency—to occur. The "loop amplification" of the system, i.e., the product of the hearing aid gain and the attenuation of the feedback path, must be greater than 1. Additionally, the phase shift of this loop amplification must correspond to an arbitrary, whole multiple of 360°.

The simplest approach for reducing feedback-caused oscillations is the permanent reduction of the hearing aid gain, so that the loop amplification remains below the critical limit even in unfavorable situations. The critical disadvantage of this approach, however, is that the hearing aid gain required given a more pronounced hearing impairment can no longer be achieved as a result of this limitation.

The whistling typical of feedback usually lies at comparatively high frequencies. Hearing aids with a volume adjustment actuatable by the hearing aid user are known in devices such as the "Swing" hearing aid model of Siemens Audiologische Technik GmbH, with which the gain of an audio signal can be varied. With this model, the boosting or lowering of the amplification of the audio signal ensues dependent on the frequency, where nearly the entire transmission range of the hearing aid is uniformly amplified given a low gain and higher frequencies are less amplified than lower frequencies given a high gain. The frequency-dependent amplification based on the measure of the volume control is thereby static.

German patent document DE 196 24 092 A1 discloses an amplifier circuit for analog and digital hearing aids. For better adaptation to the hearing capability of a test subject, the circuit comprises at least two compression circuits as sub-circuits that superimpose differently, and by which a resulting gain characteristic V can be generated at which the compression ratio decreases with an increasing input level either in a lasting fashion or at defined time intervals.

German patent document DE 196 19 312 A1 discloses an amplifier circuit for a hearing aid in which an input signal exhibits a signal level that is divided into individual, frequency band-specific sub-signal paths (channels).

European patent document EP 0 250 679 B1 discloses a hearing aid with a memory for storing coefficients with respect to a filter frequency response.

SUMMARY OF THE INVENTION

An object of the present invention is to provide a method for operating a hearing aid as well as to provide a hearing aid that allows a broad frequency response.

This object is achieved in a method for operating a digital, programmable hearing aid having at least one input transducer for picking up an input signal and converting it into an audio signal, having a signal processing unit for the processing and frequency-dependent amplification of the audio signal, and with an output transducer, in that a transmission characteristic of a maximum amplification of the audio signal over the frequency range can be set and in that advantageously least one amplification modification value is determined in at least one frequency range from a parameter that can be set by the hearing aid user and/or from a parameter that is automatically generated by the signal processing unit, by which a final amplification value is determined at the respective frequency for an initial amplification value, taking the amplification modification value into consideration, and this final amplification value is limited to the maximum gain, so that an effective system gain for the respective frequency results.

That part of the object directed to a digital, programmable hearing aid is achieved in that that hearing aid comprises at least one memory for accepting amplification values for characterizing a transmission characteristic of a maximum amplification of the audio signal over the frequency range.

The hearing aid of the invention is, for example, a hearing aid worn behind the ear, a hearing aid worn in the ear, an implantable hearing aid, a pocket hearing aid device, or any similar device. Furthermore, the hearing aid of the invention can also be part of a hearing aid system comprising a plurality of devices for supplying a hearing-impaired person, for example, part of a hearing aid system having two hearing aids worn at the head or part of a hearing aid system composed of a hearing aid worn at the head and a processor unit carried on the body.

The hearing aid comprises an input transducer for picking up an input signal. A microphone normally serves as an input transducer, this picking up an acoustic signal and converting it into an electrical audio signal. However, the invention can use other types of input transducers such as those that comprise a coil or an antenna and that pick up an electromagnetic signal and convert it into an electrical audio signal. The hearing aid of the invention also comprises a signal processing unit for the processing and frequency-dependent amplification of the audio signal. The signal processing in the hearing aid ensues using a digital signal processor (DSP) whose operation can be influenced by programs or parameters that can be transmitted to the hearing aid. This permits the operation of the signal processing unit to be adapted to the individual hearing impairment of a hearing aid user as well as to the current auditory situation in which the hearing aid is operated at the moment. The audio signal varied in this way is finally supplied to an output transducer. This is usually fashioned as an earphone that converts the electrical audio signal into an acoustic signal. However, other embodiments are also possible here, for example, an implantable output transducer that is directly connected to an ossicle and causes it to oscillate.

An audio signal is construed in a narrower sense as an electrical signal that proceeds from the signal picked up by the input transducer and that is transmitted by the hearing aid. It usually contains information lying in the audible frequency range. The audio signal can be present in analog or digital form in the signal processing in the hearing aid, where both forms of signal can also occur simultaneously in the signal path of the hearing aid. An audio signal is construed in a broader sense as an electrical signal that proceeds from the audio signal in the narrower sense as a result of further-processing, for example, by filtering, transformation, etc.

The invention provides that a transmission characteristic of a maximum gain of the audio signal can be set over a frequency range, i.e., it can be freely configured, for example, in the adaptation of the hearing aid by the acoustician. Furthermore, at least one initial amplification value is deposited in the hearing aid, this being likewise adjustable by the acoustician. The initial amplification value can be constant for the entire transmittable frequency range of the hearing aid or, alternatively, within a respective frequency band of the hearing aid. Advantageously (within certain limits), however, an arbitrary initial amplification value can be set for each frequency, so that a transmission characteristic of a normal amplification of the audio signal over the frequency range can be freely configured.

The factor by which an input audio signal with a specific signal amplitude is amplified dependent on the frequency is determined when setting the normal amplification. When the hearing aid comprises a volume control that can be set by the hearing aid user, then this factor is preferably in a middle position for setting the normal amplification, so that the hearing aid user can uniformly increase or reduce the amplification, proceeding from this basic setting. The setting of the normal amplification as well as of the maximum amplification can consider both hearing aid-specific points of view as well as individualized user points of view. For example, when adapting a hearing aid to a user indicates that feedback whistling occurs more at a specific frequency and a specific gain, then the maximum amplification in this frequency range is set below this gain.

The transmission characteristic can preferably be freely configured for a specific frequency range and for a specific value range of the amplification. The transmission characteristics can be set as such with suitable adaptation software and can be transmitted onto the hearing aid; however, these characteristics can also be fixed merely by specifying a few frequency and gain value pairs. In addition to a continuous curve, other curve shapes are also possible, including discontinuous curves.

In addition to being dependent on the frequency, the actual amplification of an audio signal in a hearing aid is also dependent on a number of other factors. Such factors can be parameters derived from the momentary setting of the volume control at the hearing aid, from the amplitude of the input signal or from a signal analysis in the signal processing unit of the hearing aid. The latter are determined, for example, by algorithms for situational analysis, for ridding (the signal) of unwanted noise or for automatic gain control (AGC). In general, thus, a number of control and regulating functions in modem hearing aids influence the momentary amplification.

The invention considers, proceeding from the initial amplification value or from the characteristic of the normal amplification over the frequency, all influencing factors with respect to the amplification for the respective frequency. When, for example, the current volume setting effects a boosting of the audio signal by 10 dB and an algorithm for suppressing unwanted noise effects a lowering by 15 dB, then an overall amplification modification value of −5 dB results. In contrast, the amplification modification value can also be a factor by which the initial amplification value is multiplied. Taking all influencing factors on the amplification (amplification modification values) at the respective frequency into consideration, the final amplification value is determined from the initial amplification value. When the final amplification value at the respective frequency exceeds the pre-set maximum amplification, then this is limited to the maximum amplification. The effective system gain is thus always less than or equal to the maximum amplification.

The invention offers the advantage that a nearly arbitrary, normal amplification as well as a nearly arbitrary, maximum amplification for a specific hearing aid can be set as a result. The signal processing in the hearing aid can thus be adapted better both to hearing aid-specific conditions as well as to the individual hearing impairment of a hearing aid user. The invention also offers the advantage that a plurality of influencing factors that simultaneously influence the amplification (for example, current setting of the volume control, gain modification using a signal processing algorithm, maximum amplification that has been set) can be taken into consideration more effectively.

One embodiment of the invention provides that the signal processing ensues in a plurality of parallel frequency channels of the signal processing unit, and the transmission characteristic of the normal amplification of the audio signal over the frequency range and/or the transmission characteristic of the maximum amplification of the audio signal over the frequency range can be separately set for the respective channel. The division of the audible frequency range into a plurality of channels facilitates the adaptation of a hearing aid when characteristic quantities relating to a specific channel (i.e., a specific frequency range) are viewed as being constant for this channel. Such characteristic quantities for a specific channel can be the hearing threshold, the discomfort threshold, but can also be the normal amplification or the maximum amplification. Only specifying a value for the appertaining channel is then required for the characterization.

DESCRIPTION OF THE DRAWINGS

Further details of the invention are described below on the basis of exemplary embodiments and the drawings.

DETAILED DESCRIPTION OF THE INVENTION

Figure 1:
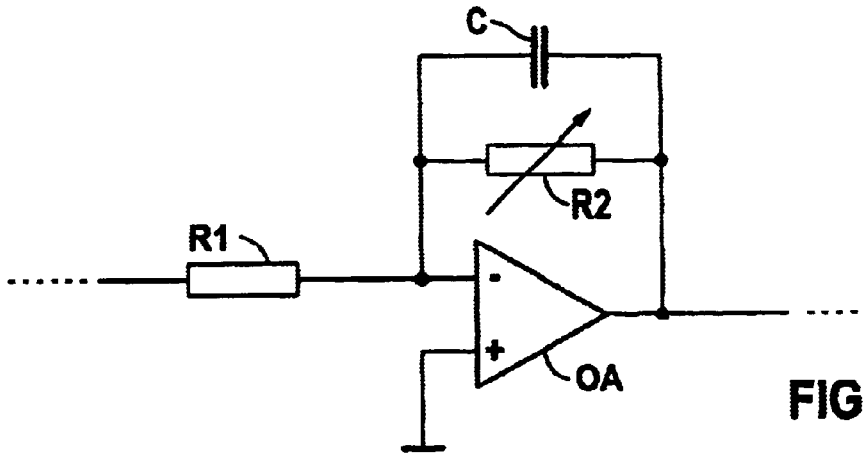
FIG 1 PRIOR ART
FIG. 1 is a schematic diagram illustrating a roll-off circuit of an analog hearing aid of the Prior Art.

FIG. 1 shows the circuit-oriented realization of a roll-off circuit in a hearing aid with analog signal processing. This amplifier circuit comprises an operational amplifier OA that is wired with an input resistor R1 as well as with an RC element composed of a potentiometer R2 and a capacitor C in the feedback branch. The gain and, thus, the volume setting at the hearing aid, can be modified with the potentiometer R2. Simultaneously with the gain, however, the limit frequency (the knee point) from which the gain decreases with increasing frequency also changes.

Figure 2:
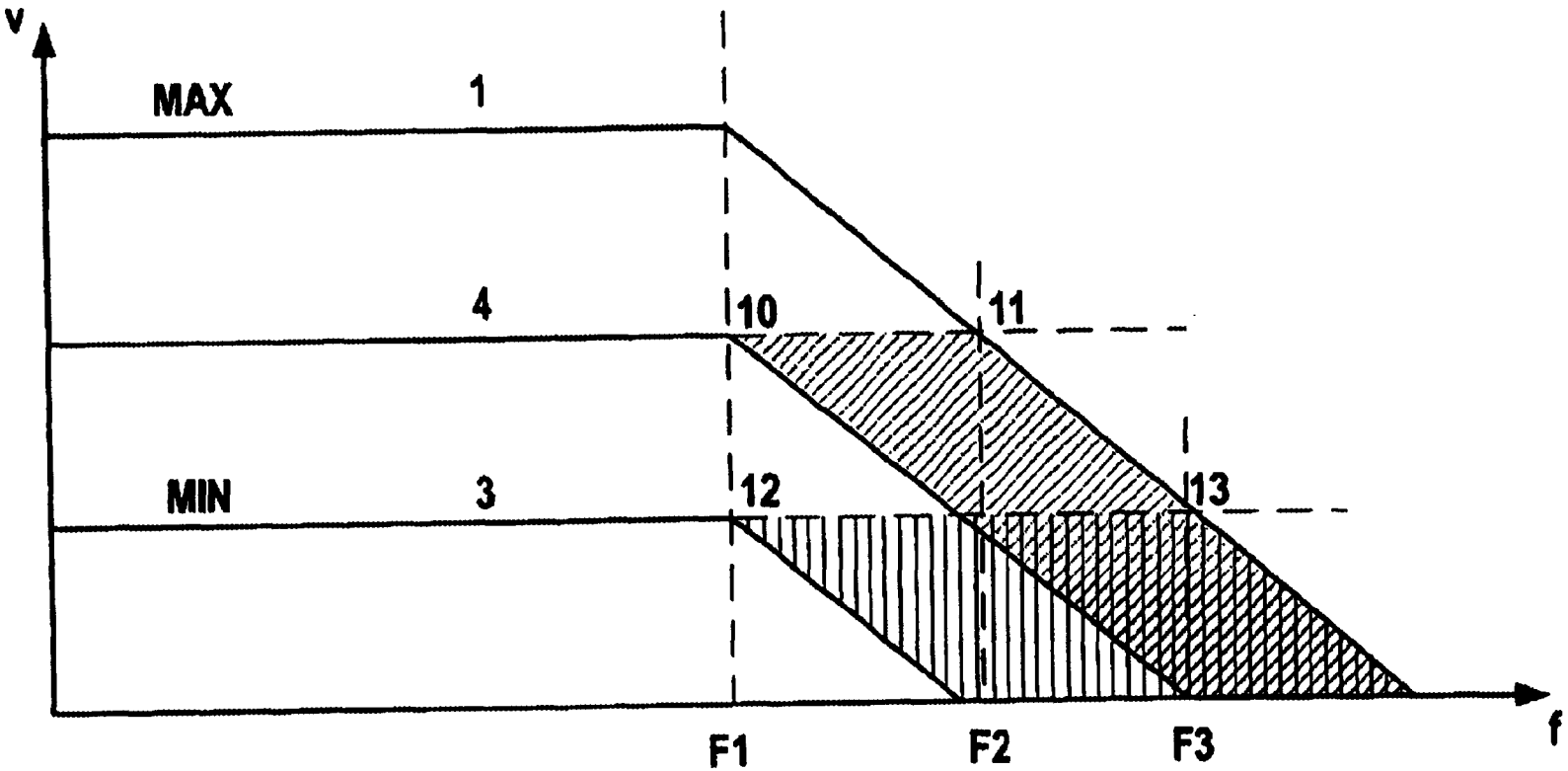
FIG. 2 PRIOR ART
FIG. 2 is a graph illustrating the transmission characteristics of the amplification over the frequency range in an analog hearing aid of the Prior Art.

FIG. 2 shows the amplification V over the frequency f for different potentiometer settings of the amplifier circuit according to FIG. 1. The characteristic 1 shows the amplification V over the frequency f at the maximum volume setting at which the resistance of the potentiometer R2 is at its highest value. The amplification is constant up to a limit frequency F1; the amplification decreases linearly with increasing frequency above the limit frequency F1. The characteristics 2 and 4 show the amplification over the frequency for the normal setting (characteristic 4) or the minimal setting (characteristic 3) of the volume control. As can also be seen from FIG. 2, as the amplification decreases, the limit frequency related to feedback above which an amplification reduction of the higher frequencies increases (i.e., at frequency F2, point 11, for characteristic 4, and at frequency F3, point 13, for characteristic 3).

The reason setting the amplification in hearing aids in the way set forth above is that unwanted feedback whistling (feedback) occurs more often with high amplification and high frequencies. Reducing the amplification at high frequencies counteracts this. The probability for feedback whistling and, thus, the beginning of the reduction at lower frequencies is all the greater the higher the amplification is.

The above-described method for lowering amplification is comparatively rigid and offers only a small latitude for individual or device-specific adaptation. In modern hearing aids, the effective amplification is often also dependent on further factors in addition to the setting of the volume control. A signal analysis that is implemented in the signal processing unit can be based on a number of different algorithms that can also run in parallel. By analyzing the input signal, the algorithms lead to an automatic gain control (AGC) or influence the amplification by automatically setting an auditory program as a result of a situation analysis. For example, an algorithm for suppressing unwanted noise can also be provided in a hearing aid, this reducing the amplification broad-band by a specific amount when unwanted noise is recognized. This procedure is shown by way of example in FIG. 2. Regardless of whether the gain is changed by a volume control or other algorithm, e.g., AGC, according to the prior art, the reduction in gain by a specific amounts effects a parallel shift of the pre-set characteristic of the normal amplification 4 by exactly this amount. This is illustrated by the characteristic 4 and characteristic 3 (a parallel shifting of characteristic 4 to, e.g., characteristic 3). Proceeding from the setting of the volume control in normal position (characteristic 4), the gain may be reduced, e.g., by the signal processing unit, so that the effective system amplification illustrated by characteristic 3 results. In other words, given the prior art, the gain shifts from the maximum characteristic 1 to the normal characteristic 4, to the minimum characteristic 3, all occur in parallel. As can also be seen from FIG. 2, the amplification about the frequency F2 that has already been reduced according to the before is reduced again.

In other words, according to the prior art, the parallel reduction of the normal characteristic 4 from the maximum characteristic 1 results in that the amplification for the normal characteristic 4 is reduced above frequency F1 at point 10, even though to prevent feedback the reduction in gain does not need to occur until frequency F2 at point 11. Thus, the diagonally shaded area in FIG. 2 reflects an unnecessary gain reduction as a consequence of the gain reduction according to the prior art. Similarly, for the minimum characteristic 3, the parallel reduction of the minimum characteristic 3 from the maximum characteristic 1 results in that the amplification for the minimum characteristic 3 is reduced above frequency F1 at point 12, even though to prevent feedback the reduction in gain does not need to occur until frequency F3 at point 13. Thus, the vertically shaded area in FIG. 2 reflects an unnecessary gain reduction as a consequence of the gain reduction according to the prior art.

Figure 3A:
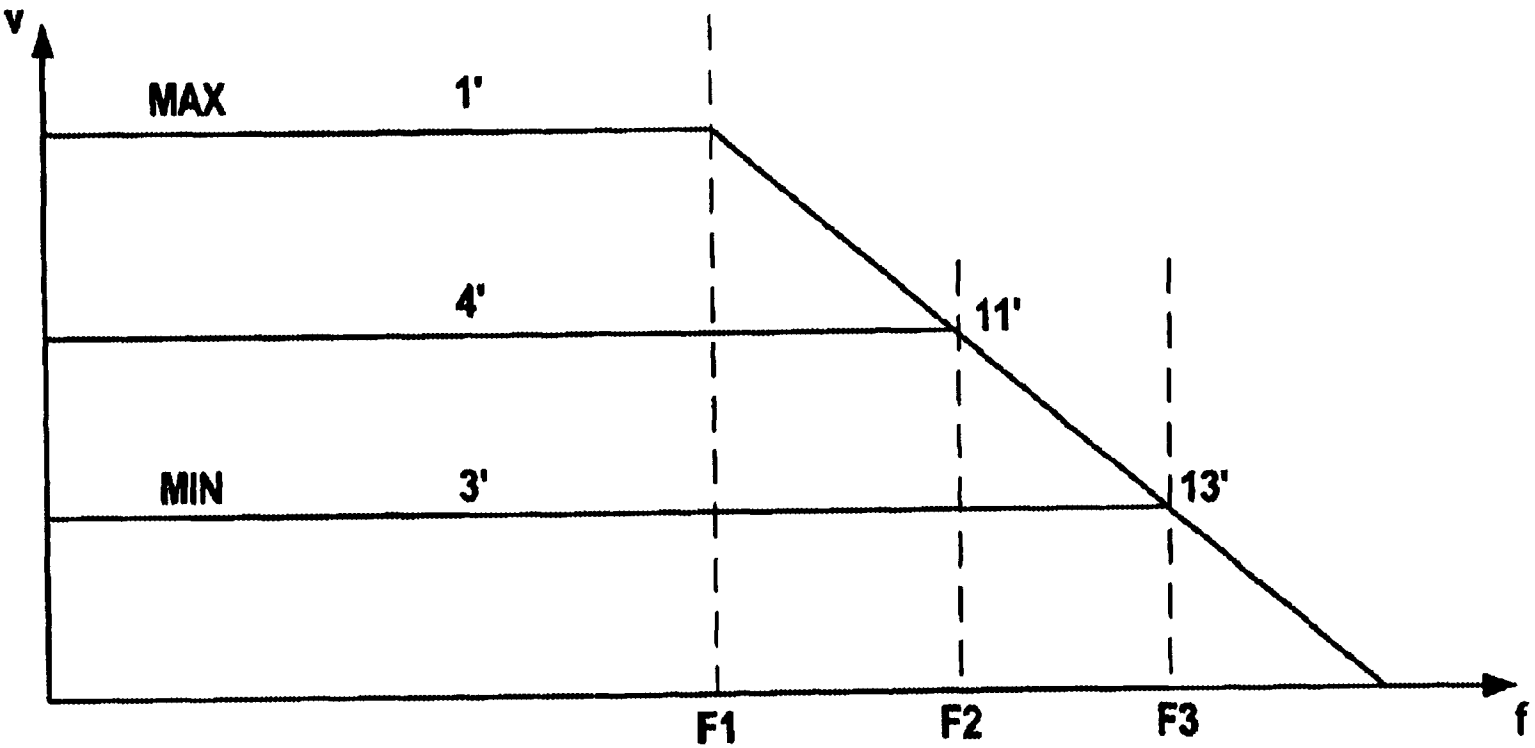
FIG. 3A is a graph illustrating the amplification over the frequency given a hearing aid of the invention having curves similar to those shown in FIG. 2, but with the higher limiting cutoff frequency.

FIG. 3A shows the amplification over the frequency given a hearing aid of the invention. A characteristic of the normal amplification 4' can thereby be largely freely configured in the frequency/amplification diagram. This characteristic can, for example, be defined by a hearing aid acoustician and transferred onto the hearing aid. When the appertaining hearing aid comprises a volume control, a middle position of the volume control is preferably allocated to this characteristic 4', so that the hearing aid user, proceeding from the normal amplification 4', can modify the amplification both toward higher amplifications as well as toward lower amplifications by actuating the volume control.

A characteristic of the maximum amplification 1' can also be deposited in the hearing aid of the invention. This, too, can be defined by the acoustician when adapting the hearing aid and can be transferred onto the hearing aid when it is programmed. When, proceeding from a pre-set amplification, the amplification is varied given a hearing aid of the invention, then an effective amplification derives, as illustrated with the characteristics 3', 4' by way of example in FIG. 3. Proceeding, e.g., from the characteristic of the maximum amplification 1', a parallel lowering of the amplification characteristic initially ensues by a specific amount (e.g., −10 dB) and the lowered characteristic 4' is then in turn limited to the characteristic of the maximum amplification 1' beginning with a frequency F2. This results in only a one-time lowering of amplification, even at high frequencies, which differs from the situation illustrated by FIG. 2 that shows the same situation given a traditional hearing aid and in which a two-time lowering in amplification ensued in the characteristic 4 above the frequency F1. In other words, characteristic curves 4' and 3' are not affected by the gain reduction of the maximum characteristic 1' at frequency F1 as they are according to the prior art, but rather are limited by the maximum characteristic 1' at frequency F2 (point 11') for characteristic 4' and at frequency F3 (point 13') for characteristic 3'.

Figure 3B:
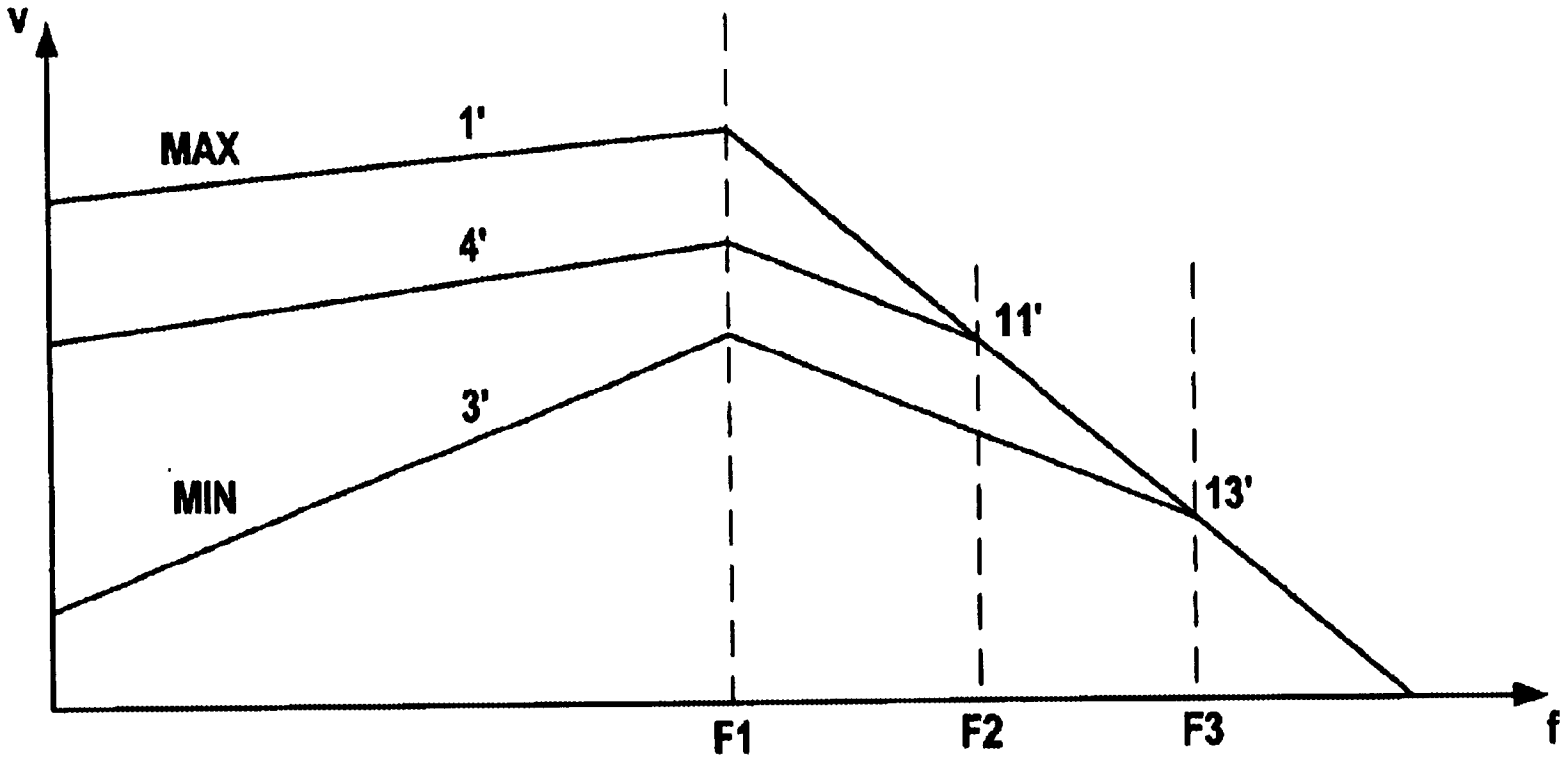
FIG. 3B is a graph illustrating the amplification over the frequency given a hearing aid of the invention, but with freely programmable transmission characteristic curves.

FIG. 3A shows the characteristics 1', 4' and 3' as having a flat gain up until the respective cutoff frequencies F1, F2 and F3 to illustrate the higher cutoff frequencies for characteristics 4, and 3' in a simple manner. FIG. 3B illustrates the same principle, except that all characteristic curves 1', 4' and 3' are all freely configurable, as described previously, with the exception that curves 4' and 3' remain limited by the maximum characteristic at frequency F2 (at point 11') and F3 (at point 13') respectively.

Figure 4:
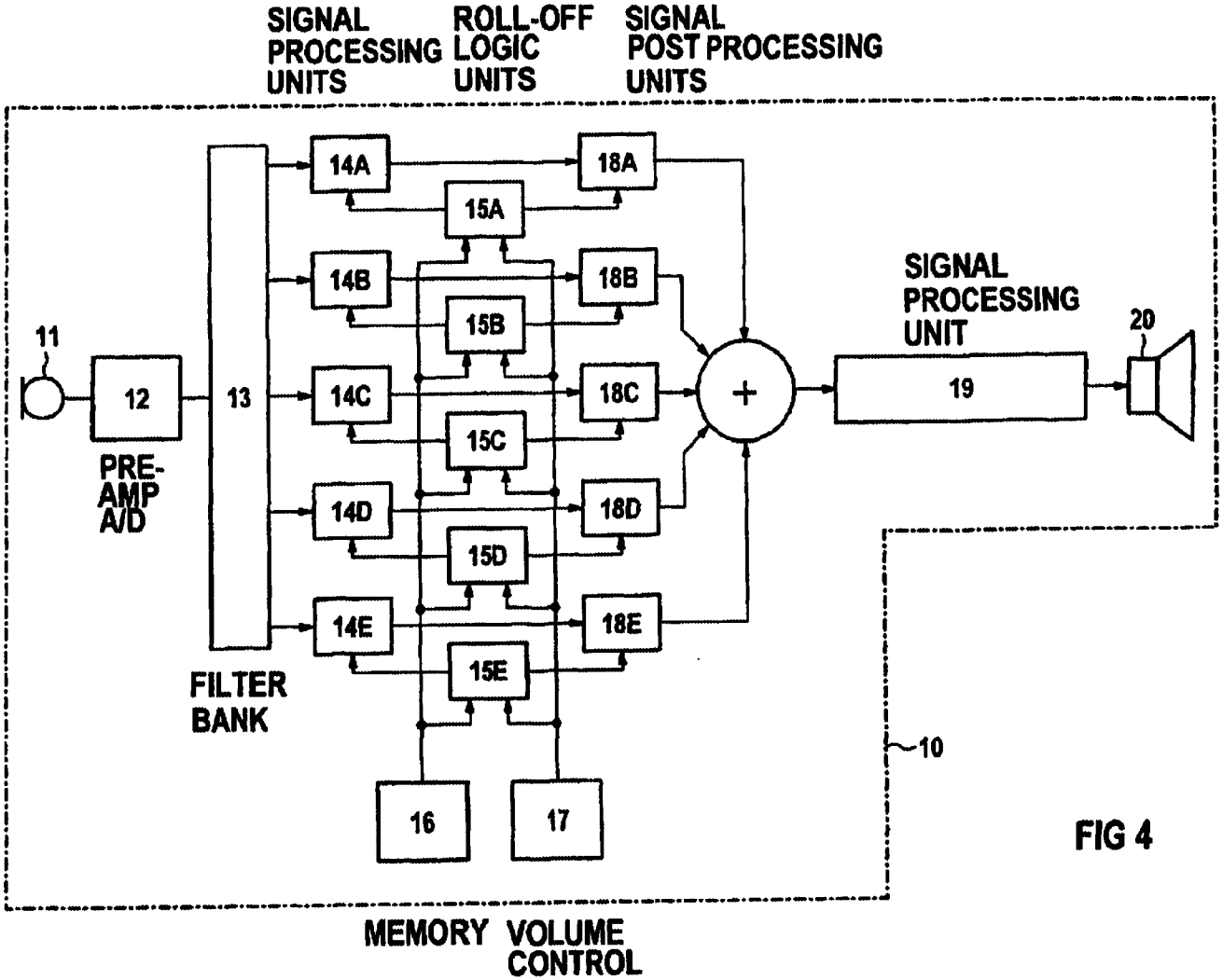
FIG. 4 is a schematic block diagram of a multi-channel hearing aid with roll-off logic in the individual channels.
Figure 5:
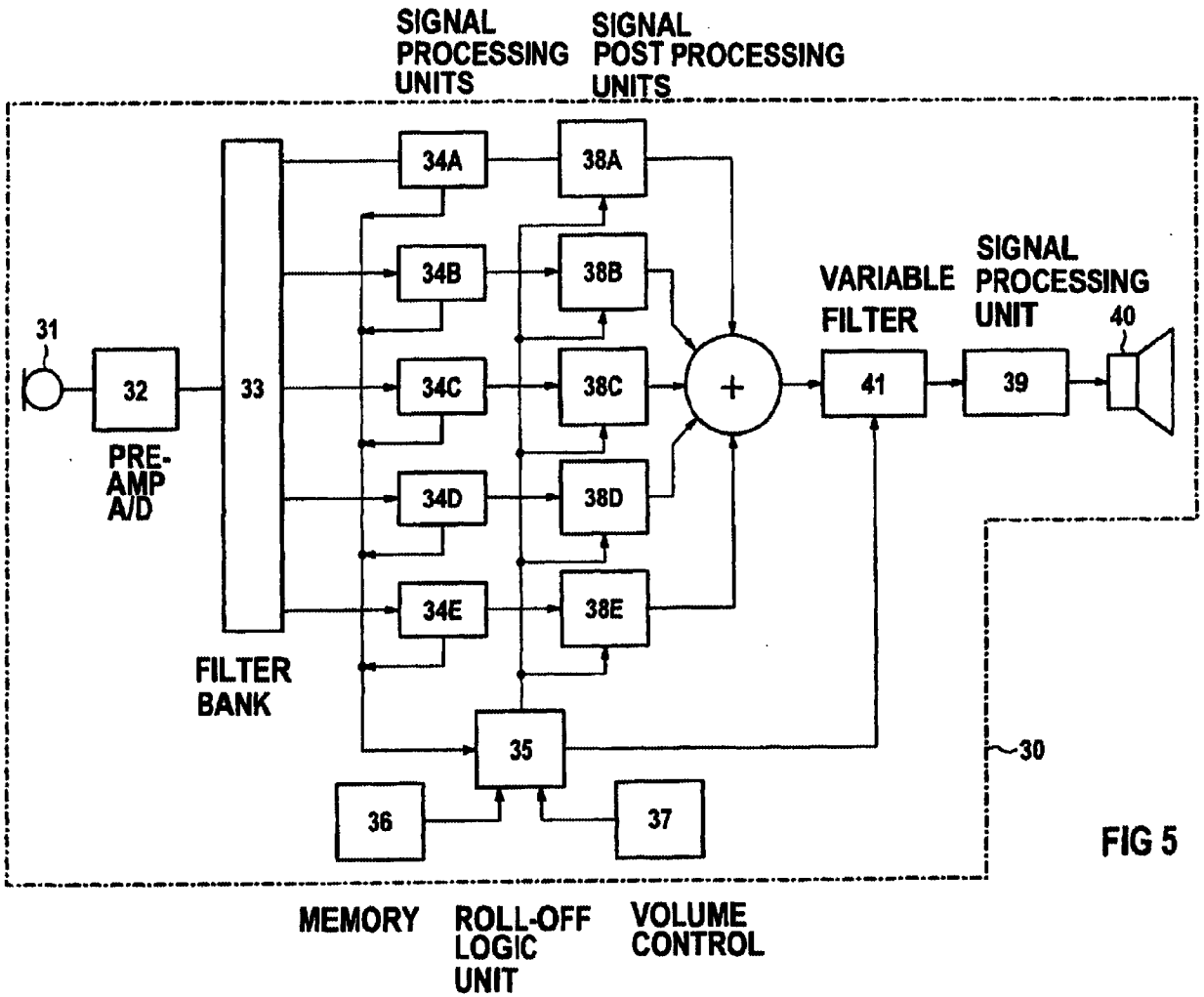
FIG. 5 is a schematic block diagram of a multi-channel hearing aid with an overall roll-off logic.

By way of example, FIGS. 4 and 5 show block circuit diagrams of hearing aids with a gain control according to the invention. A microphone 11 serves as input transducer in the hearing aid according to FIG. 4, this picking up an acoustic signal and converting it into an electrical signal. The resulting audio signal is first supplied to a pre-amplifier and A/D converter unit 12 in which the initial analog audio signal is converted into a digital audio signal.

For further-processing In a plurality of parallel channels of the hearing aid, the digital audio signal is divided into a plurality of frequency bands (channels) with the filter bank 13. The audio signals of the individual channels are first supplied to signal processing units 14A–14E in which the audio signals are individually and possibly differently filtered, for example, for adaptation to the individual hearing impairment of a hearing aid user. The signal processing units 14A–14E also perform a signal analysis in order, for example, to determine the signal level, acquire the current auditory situation and/or detect the presence of unwanted noise. Parameters are derived from this signal analysis and supplied to roll-off logic units 15A–15E. Parameters deposited in a memory 16 also enter into the roll-off logic units 15A–15E, these parameters characterizing a normal amplification as well as a maximum amplification of the audio signal over the frequency for the respective channel.

The normal amplification determines an initial amplification value for every frequency of the transmittable frequency range in the amplification calculation and can be determined both by the hearing aid manufacturer from a standard setting of the amplification as well as by the acoustician in the adaptation of the hearing aid. The maximum amplification can likewise be pre-set by the hearing aid manufacturer and be individually adapted by the acoustician. Nearly arbitrary curve shapes of the amplification over the frequency in the audible frequency range can be set for both amplifications.

As shown in the exemplary embodiment, the roll-off logic units 15A–15E can also be supplied with the current setting of a volume control 17. Using the parameters supplied to the roll-off logic units 15A–15E, these units determine a specific amplification for each frequency. For one channel, for example, the normal amplification might be 50 dB (initial amplification value), and this amplification may then be compressed with the factor 0.8 (1st amplification modification value) due to a very high signal input level, the signal can be boosted by 10 dB due to the volume control 17 (2nd amplification modification value), and, finally, can be lowered by 20 dB due to a detected noise signal (3rd amplification modification value), so that an overall amplification modification value of −20 dB and, thus, a final amplification value of 30 dB finally results taking all amplification modification values into consideration.

When this final amplification value at the respective frequency is lower than or equal to the maximum amplification, then this amplification is also the effective system amplification. Otherwise, the resulting amplification is limited to the maximum amplification, so that the latter forms the effective system amplification. The effective system amplification determined for the individual channels now controls amplifier elements 18A–18E for amplifying the processed audio signals in the individual channels. Subsequently, the audio signals of the individual channels are re-merged and supplied to an earphone 20, potentially following a signal post-processing in the signal processing unit 19 that may filter, provide a final amplification, and a D/A conversion. The earphone 20 re-converts the processed, electrical audio signal into an acoustic signal that is output into the auditory canal of the hearing aid user.

The invention can be realized in a number of different ways in terms of circuit technology. FIG. 5 shows another exemplary embodiment of the invention. In this exemplary embodiment and given a hearing aid 30, an acoustic input signal is picked up via a microphone 31 and converted into an electrical audio signal that is supplied to a pre-amplifier and A/D converter unit 32. Corresponding to the previous exemplary embodiment, the audio signal is also processed in a plurality of parallel channels that are separated with a filter bank 33. Differing from the above-described exemplary embodiment, however, the parameters determined in individual signal processing units 34A–34E are supplied to a common roll-off logic unit 35. Parameters deposited in a memory 36 that characterize the normal amplification as well as the maximum amplification also enter thereinto again. The current setting of the volume control 37 is likewise introduced. Using all of the parameters entering into the roll-off logic unit 35, the latter calculates parameters for the control of a variable filter 41, so that all amplification demands in this exemplary embodiment as well are initially met by the amplifier elements 38A–38E; differing from the previously mentioned exemplary embodiment, however, the limitation to the maximum amplification after the merging of the audio signals of the individual channels is realized with the variable filter 41, which is in turn controlled by the roll-off logic unit 35. A signal post-processing in a signal post-processing unit 39—as warranted—and the output of the processed audio signal via an earphone 40 also ensue in this exemplary embodiment.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, where the elements of the present invention are implemented using software programming or software elements the invention may be implemented with any programming or scripting language such as C, C++, Java, assembler, or the like, with the various algorithms being implemented with any combination of data structures, objects, processes, routines or other programming elements. Furthermore, the present invention could employ any number of conventional techniques for electronics configuration, signal processing and/or control, data processing and the like.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

| LIST OF REFERENCE CHARACTERS | |
|---|---|
| R1 | resistor |
| R2 | potentiometer |
| C | capacitor |
| OA | operational amplifier |
| 1, 1', 3, 3', 4, 4' | characteristics |
| F1, F2, F3 | limit frequencies |
| 10, 30 | hearing aid |
| 11, 31 | microphone |
| 12, 32 | pre-amplifier and A/D converter unit |
| 13, 33 | filter bank |
| 14A . . . 14E, 34A . . . 34E | signal processing units |
| 15A . . . 15E, 35 | roll-off logic units |
| 16, 36 | memory |
| 17, 37 | volume control |
| 18A . . . 18E, 38A . . . 38E | signal post-processing unit |
| 19, 39 | signal processing unit |
| 20, 40 | earphone |
| 41 | variable filter |

What is claimed is:

1. A method for operating a digital, programmable hearing aid, comprising:

picking up an input signal with an input transducer;

converting the input signal into an audio signal;

processing and performing a frequency-dependent amplification of the audio signal with a signal processing unit;

converting and outputting the audio signal with an output transducer;

setting a maximum-amplification transmission characteristic of a maximum amplification of the audio signal over a frequency range;

determining at least one amplification modification value in at least one frequency range from a parameter that can be set by at least one of a hearing aid user and a parameter that is automatically generated by the signal processing unit;

providing a modified amplification transmission characteristic based on the at least one amplification modification value wherein the modified amplification transmission characteristic intersects the maximum-amplification transmission characteristic at an intersection frequency, the modification amplification transmission characteristic being limited by the maximum-amplification transmission characteristic only above the intersection frequency;

setting a normal-amplification transmission characteristic of a normal amplification over frequency range that determines an initial amplification value for each frequency and serves as a basis for an amplification calculation that includes the modified amplification transmission characteristic used in the processing and performing of the frequency-dependent amplification of the audio signal.

2. The method according to claim 1, further comprising storing at least one of the maximum-amplification transmission characteristic and the normal-amplification characteristic in a memory.

3. The method according to claim 1, further comprising:

processing signals in a plurality of parallel frequency channels of the signal processing unit;

separately setting, in at least two of the frequency channels, a transmission characteristic selected from the group consisting of the maximum-amplification transmission characteristic and the normal-amplification transmission characteristic.

4. The method according to claim 3, further comprising separately setting at least one of a constant normal amplification and a constant maximum amplification for at least two of the frequency channels.

* * * * *